US005636540A

United States Patent [19]

Myers

[11] Patent Number: 5,636,540

[45] Date of Patent: Jun. 10, 1997

[54] LOCK CLIP

[75] Inventor: Gary L. Myers, Monee, Ill.

[73] Assignee: Fort Lock Corporation, River Grove, Ill.

[21] Appl. No.: 698,228

[22] Filed: Aug. 14, 1996

Related U.S. Application Data

[63] Continuation of Ser. No. 519,590, Aug. 24, 1995, abandoned, which is a continuation of Ser. No. 170,498, Dec. 20, 1993, abandoned.

[51] Int. Cl.[6] ..... E05B 9/08

[52] U.S. Cl. ..... 70/370; 24/458; 70/371; 70/466; 248/56; 411/522

[58] Field of Search ..... 70/370, 371, 466, 70/451; 24/458; 411/522, 352, 523, 524; 403/154, 155; 248/56

[56] References Cited

U.S. PATENT DOCUMENTS

| | | | |
|---|---|---|---|
| 2,014,558 | 9/1935 | Cramer | 70/370 |
| 2,487,803 | 11/1949 | Heimann | 70/370 |
| 2,744,185 | 5/1956 | Cawley | 70/370 |
| 2,948,141 | 8/1960 | Vahlstrom | 70/370 |
| 4,099,397 | 7/1978 | Dauenbaugh | 70/371 |
| 4,601,448 | 7/1986 | Miyazaki et al. | 248/56 |
| 4,640,478 | 2/1987 | Leigh-Monstevens | 248/56 X |
| 4,735,534 | 4/1988 | Oehlke | 403/155 X |
| 4,886,408 | 12/1989 | Killian et al. | 411/522 X |
| 5,410,899 | 5/1995 | McConnell | 70/370 |

FOREIGN PATENT DOCUMENTS

| | | | |
|---|---|---|---|
| 830359 | 7/1938 | France | 70/370 |
| 828496 | 1/1952 | Germany | 70/370 |
| 1218041 | 1/1971 | United Kingdom | 70/370 |
| 1288840 | 9/1972 | United Kingdom | 403/155 |

*Primary Examiner*—Lloyd A. Gall

*Attorney, Agent, or Firm*—Leydig, Voit & Mayer, Ltd.

[57] ABSTRACT

A clip for securing a cylindrical lock shell within a mounting hole by frictionally engaging a region of the shell includes a pair of extending legs, each including a flat portion, a curved portion and a contact portion. The legs provide the frictional contact to the lock shell. Also included is a generally planar bridge portion connecting the two legs. The bridge portion is co-planar with the flat region on the legs. The curved portion of each leg has an apex, which is disposed eccentrically of a longitudinal center line of the cylindrical lock shell.

9 Claims, 1 Drawing Sheet

LOCK CLIP

This is a continuation of application Ser. No. 08/519,590 filed on Aug. 24, 1995, now abandoned which is a continuation of application Ser. No. 08/170,498 filed on Dec. 20, 1993, now abandoned.

FIELD OF THE INVENTION

This invention relates generally to securement devices for panel-mounted locks, and particularly to a lock clip for securing a lock shell within a mounting hole of a panel or the like.

BACKGROUND OF THE INVENTION

Mounting of cam locks to panel openings or the like is achieved in a variety of ways. The shell of the cam lock is fed through the mounting hole in the panel which usually has a size and shape similar to the size and profile of the shell. Different types of securing devices are then used to secure the lock shell within the mounting hole and to secure the front face of the lock against the front surface of the panel. One way that the lock shells are secured to the mounting hole is by means of a threaded nut which may be received on threads on the exterior of the lock shell. Such nuts have the advantage of being able to securely hold the shell in place. At the same time, manipulation of a nut over a lock shell can be very inconvenient in difficult to reach situations. Furthermore, quick removal of such a nut to allow for changing of the lock is not possible with this configuration.

Another means for securing the lock shell into the mounting hole is by a lock clip. Such lock clips are generally formed pieces of resilient metal, such as spring steel. They include two illustratively downwardly-extending legs which straddle the lock shell. The inner surfaces of the legs may frictionally engage flat portions on the lock shell to secure it in place. Alternatively, the lock shell may include grooves for receiving the legs to secure the shell in place. Each of the legs has a curved profile which is symmetric with respect to the lock plug when the clip is in its lock-securing position. Each leg also includes a bend at each end, each bend being adapted to contact the rear surface of the panel about the mounting hole. Because of the symmetric orientation of these bends with respect to the lock shell, the lock clip exerts an equal force toward the panel at each of the points of contact when a pulling force is exerted on the lock. Such pulling forces may come either from the forces exerted on the lock by key pull-out, or they may come from tampering. The intermediate portions of the legs between the bends frictionally contact either the flats or the grooves on the lock shell. The force due to this frictional contact is thus directed away from the panel, and maintains the front face of the lock shell in engagement with the panel.

Use of a lock clip is significantly more convenient than use of a nut, since the lock clip can easily be slid in and out of engagement with the lock shell once the shell is in place. Further, the lock clip does not require any translation axially along the lock shell, as does a nut. Finally, the lock clip can be easily removed from a given lock shell to allow for easy removal of the shell from the mounting hole. At the same time, however, the lock clip does not offer the desired security and prevention against pull-out offered by a nut arrangement. Furthermore, slight misalignment of the lock plug with respect to the rear surface of the panel may result in the shell being canted within the mounting hole. Such canting is undesirable since it allows for limited rotation of the shell within the mounting hole, leading in turn to further loosening of the shell within the hole.

SUMMARY OF THE INVENTION

Accordingly, it is a primary object of the invention to provide a lock clip that combines the convenience and advantages of previous lock clips with increased securement and stability.

It is a related object of the invention to provide a lock clip that assists in preventing canting of a lock shell within a mounting hole.

In accordance with these and other objects of the invention, a lock clip is provided with extending leg portions having both a flat region and a curved region. The curved region of each leg is disposed such that, with the lock clip in its lock-securing position, the apex of the curved portion extends beyond the longitudinal center line of the lock shell. Because of this unique configuration of the lock clip, the forces being exerted by the lock clip on the rear of the panel are not symmetric. As a result, a slight rotational moment is exerted on the lock shell, which tends to assist in securing it within the mounting hole. Further, the flat portion on each leg of the clip gives an increased contact surface between the clip and the panel mount along that portion. This also leads to greater stability, and helps to prevent accidental misalignment of the lock clip, and thus prevents accidental canting of the lock shell within the mounting hole. Overall, this lock clip gives enhanced performance while maintaining the ease and convenience of use of the lock clip configuration.

DETAILED DESCRIPTION OF THE PREFERRED EMBODIMENT

While the invention will be described in connection with a particular preferred embodiments, it will be understood that it not intended to limit the invention to this embodiment. On the contrary, it is my intention to cover all alternatives, modifications and equivalents as may be included within the spirit and scope of the invention as defined by the appended claims. Furthermore, while the clip according to the invention is described with particular reference to securing a lock, it may be used to secure any generally cylindrical member within a complementally-shaped hole in a panel.

Figure 1:
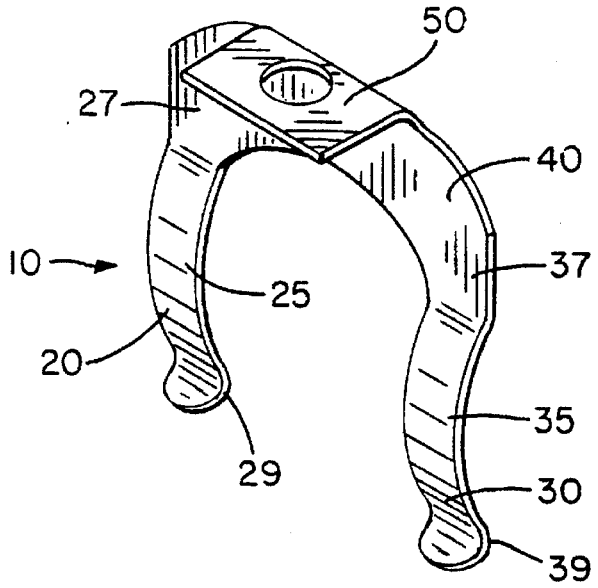
FIG. 1 shows a perspective view of a lock clip according to one embodiment of the invention.

Turning now to the drawings, FIG. 1 shows an illustrative lock clip 10 according to the invention. Clip 10 includes two downwardly-extending legs 20 and 30. Each leg includes a curved portion, designated by reference numerals 25 and 35, and a flat portion designated by reference numerals 27 and 37. The legs either frictionally engage flats on the lock shells, or are received within grooves on the lock shell adapted for that purpose. A bridge section 40 adjoining the two legs 20, 30 is also included, and is generally co-planar with flat sections 27, 37 of the legs 20, 30. A tab 50 projects away from the bridge portion 40 to allow for easy gripping of the lock clip 10. Each of the legs 20, 30 also includes a contact portion which engages the rear wall of the panel. In this embodiment, the contact portion is in the form of a bend 29, 39 near the distal end of each leg.

Figure 2:
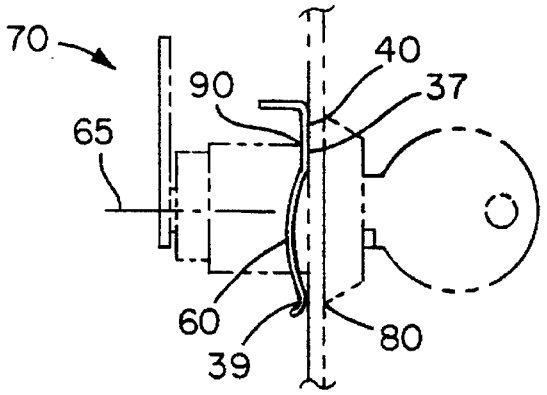
FIG. 2 shows an elevational environmental view showing a lock clip according to the invention securing a cam lock and its associated lock shell in place within a mounting hole in a panel.
Figure 3:
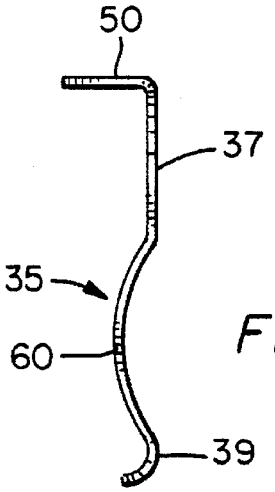
FIG. 3 is a side elevational view of the lock clip according to one embodiment of the invention.
Figure 4:
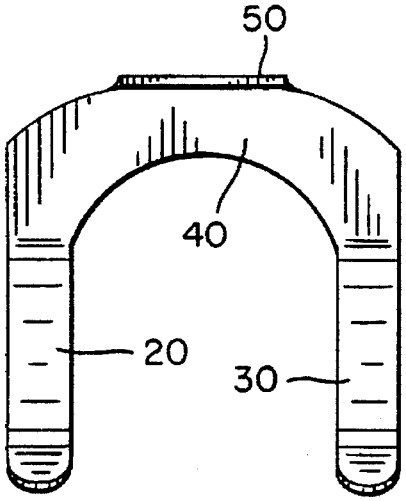
FIG. 4 is a front elevational view of a lock clip according to one embodiment of the invention.

The orientation of lock clip 10 in its lock-securing position with respect to a lock shell is seen in the environmental drawing of FIG. 2. According to one aspect of the invention, the curved portion 35 of the lock clip includes an apex 60, which is disposed beneath or eccentrically offset from the longitudinal center line 65 of the lock shell when the lock clip 10 is in its lock-securing position. Of course, in other orientations, the apex 60 is not below the center line, but is otherwise located eccentrically of it. With this below-center or eccentric design for the leg 30, and with the lock clip 10 contacting the panel at bend 39 and at flat portion 37, a net rotational moment is exerted on the lock shell in the direction indicated by the arrow 70 in FIG. 2 when a pull-out force is exerted on the lock. This rotational moment is caused by the asymmetry of the forces exerted by the lock clip 10 on the panel rear surface. The rotational moment that results enhances the security of the lock shell within the mounting hole. Because of this rotational moment, there will be enhanced contact between the shell and the panel at the contact points 80, 90 indicated in FIG. 2. For a properly sized hole and shell, this enhanced contact will prevent any undue rotation of the shell within the hole.

Stability and security of the lock clip 10 are also enhanced by the extended area of contact between the upper portion of the clip 10 and the rear surface of the panel. The upper portion of lock clip 10 is the flat portion of the comprising clip sections 27, 37 making up the legs, as well as the flat, bridge portion 40. With the lock clip in its engaging position, the full extent of this flat surface contacts the rear of the panel. This gives advantageous security performance over previous clips wherein only a single point, or a single line of contact was present. This extended contact surface more completely distributes the forces that become associated with the lock clip upon an attempted pull-out of the lock shell. The extended contact surface also ensures more accurate positioning of the lock clip on the lock shell upon installation. Further, stability may be improved by the bottom surface of bridge portion 40 engaging threads in the lock shell, if any are present.

Although the lock clip 10 has the above-mentioned advantageous security and stability features, it still maintains a simplistic design, and convenient use. A lock clip 10 engaged to a lock shell can be easily withdrawn from the shell by pulling on the tab 50 designed for that purpose. Thus, lock clip 10 provides both a convenient and a secure means for securing a lock shell within a mounting hole in a panel or the like.

What is claimed is:

1. A lock device secured within a complementally-shaped hole in a panel, said lock device comprising in combination:

a lock shell including a generally cylindrical outer surface and a longitudinal center line;

a lock clip adapted to maintain the lock shell within the hole in the panel by frictionally contacting a region of the lock shell and engaging a rear portion of the panel adjacent to said hole, the lock clip comprising:

a pair of extending legs, each leg including a flat portion, a curved portion, and a contact portion at the distal end thereof for providing frictional contact;

a generally planar bridge portion connecting the two legs, the bridge portion being co-planar with the flat portions of the legs, the bridge portion and the flat portions of the legs including a less than semicircular arched interior surface that connects the legs, said arched interior surface the generally cylindrical outer surface of the lock shell to engage the lock shell when the lock clip is in its securing position; and the curved portion of each extending leg having an apex, the apex of each leg being disposed below the longitudinal center line of the lock shell when the lock clip is in its securing position.

2. The lock device of claim 1, wherein the flat portion of each leg and the bridge portion form an extending planar contact surface between the lock clip and the rear portion of the panel.

3. The lock device of claim 1, wherein the contact portion on each leg contacts the rear portion of the panel.

4. The lock device of claim 3, wherein the contact portion is a bend in each leg.

5. The lock device of claim 1, wherein a tab extends away from a surface of the bridge portion for manual actuation of the lock clip.

6. The lock device of claim 1, wherein the lock clip is formed of a resilient material.

7. The lock device of claim 6, wherein the lock clip is formed of spring steel.

8. A lock device secured within a complementally-shaped hole in a panel, said lock device comprising in combination:

a generally cylindrical lock shell having an outer surface, a longitudinal center line, and a horizontal plane which extends through the longitudinal center line; and a lock clip adapted to maintain the lock shell within the hole of the panel by frictionally contacting a region of the lock shell and engaging a rear portion of the panel adjacent to said hole, the lock clip comprising:

a pair of extending legs, each leg including a flat portion, an intermediate curved portion, and a contact portion at the distal end thereof for providing frictional contact, the curved portion of each leg including an apex, the legs having a first plane which is co-planar with the flat portions and is adjacently parallel to the panel and a second plane which extends through the apex of each curved portion and is perpendicular to the first plane of the legs; and a generally flat bridge portion connecting the two legs and being co-planar with the first plane thereof, the bridge portion and the flat portions of the legs including an interior surface, the interior surface having at least one engagement portion which contacts the outer surface of the lock shell when the lock clip is in its securing position, the second plane of the legs being parallel to but offset from the horizontal plane of the lock shell when the lock clip is in its securing position, the perpendicular distance between said engagement portion and the second plane of the legs being greater than the perpendicular distance between said engagement portion and the horizontal plane of the lock shell when the lock clip is in its securing position.

9. In a lock device secured within a complementally-shaped hole in a panel, said lock device comprising in combination:

a generally cylindrical lock shell having an outer surface, a longitudinal center line, and a horizontal plane which extends through the longitudinal center line; and a lock clip adapted to maintain the lock shell within the hole of the panel by frictionally contacting a region of the lock shell and engaging a rear portion of the panel adjacent to said hole, the lock clip comprising:

a pair of extending legs, each leg including a flat portion, an intermediate curved portion, and a contact portion at the distal end thereof for providing frictional contact, the curved portion of each leg including an apex, the legs having a first plane which is co-planar with the flat portions and is adjacently parallel to the panel and a second plane which extends through the apex of each curved portion and is perpendicular to the first plane of the legs; and a generally flat bridge portion connecting the two legs and being co-planar with the first plane thereof, the bridge portion and the flat portions of the legs including an interior surface, the interior surface having at least one engagement portion which contacts the outer surface of the lock shell when the lock clip is in its securing position, the improvement characterized by:

the second plane of the legs being parallel to but offset from the horizontal plane of the lock shell when the lock clip is in its securing position; and the perpendicular distance between said engagement portion and the second plane of the legs being greater than the perpendicular distance between said engagement portion and the horizontal plane of the lock shell when the lock clip is in its securing position.

* * * * *